US012350731B2

(12) United States Patent
Schoener

(10) Patent No.: US 12,350,731 B2
(45) Date of Patent: Jul. 8, 2025

(54) METHOD FOR CREATING ELEVATIONS IN A WORKPIECE, APPARATUS AND PRODUCT

(71) Applicant: Neumayer Tekfor Engineering GmbH, Hausach (DE)

(72) Inventor: Daniel Schoener, Oberharmersbach (DE)

(73) Assignee: NEUMAYER TEKFOR ENGINEERING GMBH, Hausach (DE)

( * ) Notice: Subject to any disclaimer, the term of this patent is extended or adjusted under 35 U.S.C. 154(b) by 345 days.

(21) Appl. No.: 17/767,231

(22) PCT Filed: Oct. 2, 2020

(86) PCT No.: PCT/DE2020/000231

§ 371 (c)(1),
(2) Date: Apr. 7, 2022

(87) PCT Pub. No.: WO2021/069001

PCT Pub. Date: Apr. 15, 2021

(65) Prior Publication Data

US 2022/0371078 A1 Nov. 24, 2022

(30) Foreign Application Priority Data

Oct. 8, 2019 (DE) ..... 10 2019 006 975.7

(51) Int. Cl.
*B21J 5/00* (2006.01)
*B21J 5/02* (2006.01)
(Continued)

(52) U.S. Cl.
CPC ..... *B21J 5/008* (2013.01); *B21J 5/02* (2013.01); *B21J 13/02* (2013.01); *B21K 1/30* (2013.01)

(58) Field of Classification Search
CPC ..... B21J 5/008; B21J 5/02; B21J 5/12; B21J 13/02; B21J 5/025; B21K 1/30; B21K 1/28; B21K 1/305; B21K 1/32
See application file for complete search history.

(56) References Cited

U.S. PATENT DOCUMENTS 2,393,628 A 1/1946 Goldie et al.
7,347,076 B1 * 3/2008 Cha ..... B21K 1/305 72/344

(Continued)

FOREIGN PATENT DOCUMENTS

DE 195 49 714 B4 6/2006
DE 198 09 039 B4 8/2007

(Continued)

OTHER PUBLICATIONS

International Search Report (PCT/ISA/210) issued in PCT Application No. PCT/DE2020/000231 dated Feb. 15, 2021 with English translation (six (6) pages).

(Continued)

*Primary Examiner* — Teresa M Ekiert
(74) *Attorney, Agent, or Firm* — DICKINSON WRIGHT PLLC

(57) ABSTRACT

The invention relates to a method for creating elevations (21) in a workpiece (1) by forming techniques. In a first step, depressions (11, 12) are created, with dimensions that differ from dimensions of depressions (20) to be created between the elevations (21). In a second step, the elevations (21) are created from regions (13) between the depressions (11, 12). The invention also relates to an apparatus for implementing the method and to a product thereby created.

20 Claims, 6 Drawing Sheets

(51) Int. Cl.
*B21J 13/02* (2006.01)
*B21K 1/30* (2006.01)

(56) References Cited

U.S. PATENT DOCUMENTS

| | | | | |
|---|---|---|---|---|
| 2008/0104843 | A1 | 5/2008 | Matsushita | |
| 2008/0166579 | A1 | 7/2008 | Kotthoff | |
| 2012/0216644 | A1 | 8/2012 | Sakamaki et al. | |
| 2015/0359142 | A1* | 12/2015 | Tanaka | B21J 5/12 72/352 |

FOREIGN PATENT DOCUMENTS

| | | | |
|---|---|---|---|
| DE | 11 2012 000 291 | B4 | 8/2017 |
| DE | 10 2018 110 119 | B3 | 6/2019 |
| EP | 0 275 561 | A2 | 7/1988 |
| EP | 1 888 276 | B1 | 2/2013 |
| JP | 9-206874 | A | 8/1997 |
| JP | 2000-210753 | A | 8/2000 |
| JP | 2005-103601 | A | 4/2005 |
| WO | WO 2006/117946 | A1 | 11/2006 |

OTHER PUBLICATIONS

German-language Written Opinion (PCT/ISA/237) issued in PCT Application No. PCT/DE2020/000231 dated Feb. 15, 2021 (six (6) pages).

German-language Search Report issued in German Application No. 10 2019 006 975.7 dated Jul. 27, 2020 with partial English translation (13 pages).

* cited by examiner

METHOD FOR CREATING ELEVATIONS IN A WORKPIECE, APPARATUS AND PRODUCT

BACKGROUND AND SUMMARY OF THE INVENTION

The present invention relates to a method for forming elevations in a workpiece. The invention also relates to a corresponding apparatus and to a correspondingly produced product.

In the prior art, it is known for geometries—such as, for example, toothing formations—to be produced in (in particular metallic) components by means of cold-forming or hot-forming operations. It is also possible to carry out a combination of cold-forming and hot-forming operations, in the case of which first of all initial pressing takes place at a high temperature and then definitive pressing takes place in the cold state. Such components are distinguished by increased stability and are commonly used in vehicle manufacturing. For the forming operation, a workpiece which is to be processed—also referred to as a blank—is introduced into a tool which has a structure—e.g. made up of elevations or depressions. This structure influences the flow of the material of the workpiece when the workpiece is subjected to a mechanical pressure. Examples in the prior art for producing toothing formations are provided, for example, by EP 0 275 561 A2, DE 198 09 039 B4, EP 1 888 276 B1, US 2008/0104843 A1 or DE 11 2012 000 291 B4.

Follow-up machining is usually necessary to achieve dimensional accuracy of the finished components. It is therefore usually the aim to increase the accuracy of the finished components as early as the forming step. In addition, a further problem is the fact that, for some shapes which are to be produced and also for the loading capacity of the components, it is desirable, or even necessary, for the workpiece, and therefore also the tool, to be subjected to the lowest possible forces during the forming operation.

DE 10 2018 110 119 B3 describes a production method in which first of all an intermediate product with elevations is produced and then a final shape is produced. A lateral offset between the elevations and the hollow shape of a tool causes the material of the elevations to flow in a lateral direction and therefore in a different direction to that in which a pressing force is active.

The invention is based on the object of proposing an alternative method and an alternative apparatus in which, for the production of even complex components, the workpiece and the tool are subjected to the lowest possible level of mechanical loading.

The invention achieves the object by a method and by an apparatus which is preferably suitable for implementing the method, and also by a product which has been produced using the method and/or the apparatus.

The invention achieves the object by a method for forming elevations in a workpiece, wherein the method has at least the following steps: that, in a first step, depressions are produced in the workpiece such that the depressions have dimensions which differ from dimensions of depressions which are to be produced between the elevations, and that, in a second step, the elevations are produced from regions of the workpiece between the depressions. Depending on the configuration, the dimensions relate, for example, to the opening angles of the depressions, starting from their lowermost region within the workpiece, and/or to the volume enclosed by the depressions. A dimension in respect of which the depressions differ from one another is, for example, the depth thereof relative to the outer contour of the workpiece which has not yet been subjected to any forming operation. The depressions here are, on the one hand, those which are produced by the first step and, on the other hand, those which, following the second step, are located between the elevations which are to be produced. The latter depressions therefore preferably also have the predefined target dimension or final dimension following the second step.

In one configuration of the method, provision is made so that, in the first step, the depressions are produced in the workpiece such that the depressions have different dimensions.

In this configuration, therefore, the first step produces, from a blank, an intermediate product which has different depressions (alternatively referred to as gaps). The elevations of the final product are then produced, in the second step, from the material regions between the depressions of the intermediate product. The depressions of the intermediate product are preferably distributed in alternating fashion radially around it. It is therefore the case that the second step produces at least one elevation from the material which is located between two depressions of different dimensions.

Depending on the configuration, the depressions of smaller dimensions here also provide for orientation of the intermediate product relative to the tool for the second step. This means that, in the second step, the intermediate product and tool are automatically properly oriented in relation to one another.

In one configuration, the depressions are produced such that there are only two different dimensions. This means that only two types of depression are produced. In a further configuration, more than two types of depression are produced. In one configuration, both types of depression deviate from the final dimensions of the depressions which are to be produced in the second step between the elevations.

One configuration of the method consists in that, in the first step, the depressions are produced such that depressions of larger dimensions are at smaller spacings from a longitudinal axis of the workpiece than depressions of smaller dimensions. In this configuration, the depressions are produced such that they have different depths. The depth here is determined by that region of the depression which is closest to the longitudinal axis. In one configuration, the depressions also differ from one another by way of their opening angles. In an alternative, or supplementary, configuration, the depressions differ from one another in terms of the respectively enclosed volume.

One configuration of the method makes provision so that, in the first step, depressions of larger dimensions are produced such that the larger dimensions are larger than dimensions of the depressions which are to be produced in the second step between the elevations. In the second step, depressions (or alternatively referred to as valleys) are correspondingly also achieved between the elevations. The dimensions of these valleys here are smaller than the dimensions of the depressions of the larger dimensions from the first step. The larger depressions (in the case where more than two different sizes of dimension are given, these are, in particular, the largest depressions, which correspondingly have the largest dimensions of the different types of depression) are therefore, in particular, larger than the finished dimensions of the valleys which are to be produced in the second step. This means that the depressions which are achieved from the first step are, in part, reduced in size in the second step. This is, for example, possible by the material around the depressions of smaller dimensions flowing in the direction of the depressions of larger dimensions. In one configuration, the large depressions are larger, and the small depressions are smaller, than the depressions (or also valleys) which are to be produced between the elevations of the final product.

One configuration of the method consists in that, in the first step, the depressions are produced such that depressions of larger and smaller dimensions alternate with one another—regularly or irregularly. If, in one configuration, only depressions of two different dimensions are present following the first step, then, in one configuration, the two different dimensions alternate. This would therefore be an example of regular alternation. In an alternative configuration, two depressions of the same dimensions follow one after the other at least in one instance. This would be an example of irregular alternation.

It is generally the case for the present description that, where mention is made of the same dimensions, this is meant in the sense of production accuracy.

One configuration of the method makes provision so that, in the first step, the depressions are produced such that material from regions of the workpiece in which depressions of larger dimensions are produced comes into contact with a tool earlier than material from regions in which depressions of smaller dimensions are produced. In this configuration, the depressions are produced by the material of the workpiece coming into contact with a tool. Accordingly, the tool has a structure which displaces the material or into which the material flows. The tool is preferably configured such that first of all the material from the regions from which the depressions of larger dimensions are produced comes into contact with the tool. These regions are therefore subjected to an earlier forming operation than the regions from which the depressions of smaller dimensions are produced.

One configuration of the method consists in that, in the second step, the elevations are produced such that material of the workpiece from depressions of smaller dimensions comes into contact with a tool earlier than material of the workpiece from depressions of larger dimensions. In this configuration, in the second step, the forming operation for the material in the region of the depressions of smaller dimensions begins prior to the forming operation for the material in the region of the depressions of larger dimensions. The contact between the workpiece and the tool should be understood here such that this gives rise to the material of the workpiece being subjected to a forming operation. Depending on the configuration, the different points in time for the contact depend on the shape of the workpiece following the first step and/or on the structure of the second workpiece. In one configuration, the tool used for the second step has a homogeneous structure, wherein the respectively different instances of contact of the individual regions of the workpiece with the tool are achieved by the depressions having said different dimensions.

One configuration of the method makes provision so that, in the second step, the elevations are produced such that material of the workpiece from depressions of smaller dimensions flows in the direction of the depressions of larger dimensions. In this configuration, the material of the depressions of smaller dimensions flows in the direction of the depressions of larger dimensions in order thus also to produce the elevations.

A further configuration of the method makes provision so that, in the first step, the depressions in the workpiece are produced such that the depressions have larger dimensions than depressions which are to be produced between the elevations. In one configuration (see what has been said above), depressions of smaller dimensions are located between the excessively large—relative to the final shape—depressions. In an alternative configuration, the region between the depressions is free of any forming activity. An alternative way of putting this is that the depressions between the larger depressions have insignificant dimensions.

Accordingly, one configuration makes provision so that, in the first step, the depressions are produced at such a radial spacing from one another that, in the second step for producing the elevations, there is space present within this radial spacing for at least one additional depression which is to be produced between the elevations. In this configuration, therefore, the excessively large depressions are placed far enough apart from one another for yet a further depression to be introduced between them. If it is therefore the case that, in the first step, two excessively large depressions are produced in a portion of the workpiece, then at least three depressions of a final dimension are produced in this same portion in the second step.

One configuration relates to the fact that, in the first step, the space for the at least one additional depression remains in an unworked state. In this configuration, the radial space between the at least two excessively large depressions therefore remains free of any working activity, i.e. there is in particular no depression located there.

One configuration of the method consists in that, in the first step, the workpiece is introduced into a first tool, and a first mechanical force is applied to the workpiece essentially along a longitudinal axis of the workpiece, in that, following the first step and prior to the second step, the workpiece is removed from the first tool, and in that, in the second step, the workpiece is introduced into a second tool, and a second mechanical force is applied to the workpiece essentially along the longitudinal axis. This configuration involves two tools, into which the workpiece which is to be subjected to a forming operation is introduced in succession: the first tool, depending on configurations, provides for the depressions with the different dimensions and the second tool produces the desired elevations with the target dimensions. In one configuration, the first tool has a structure which results in the workpiece being subjected only to a partial forming operation, and therefore portions between depressions produced are not deformed or are free of deformation.

According to a further teaching, the invention achieves the object by an apparatus for forming elevations in a workpiece, wherein a tool encloses a cavity for accommodating the workpiece, wherein the tool has a tooth projecting into the cavity, wherein end regions of the teeth of the tool are at different spacings from a longitudinal axis of the tool, and wherein the teeth of the tool have different dimensions.

The tool (in one configuration, this is preferably a first tool for carrying out the first step of the aforementioned method) comprises a cavity into which a workpiece is introduced in order to be subjected to a forming operation. For the forming operation, the tool has a structure which is present, in particular, along an inner wall which partially encloses the cavity. The structure is configured, in particular, such that the forming operation produces depressions (alternatively referred to as gaps) in the workpiece. Teeth are provided for this purpose, the material of the workpiece flowing around the teeth during the forming operation. Teeth of the tool are generally understood here to be any shape which extends into the cavity which accommodates the workpiece for the forming operation. The teeth here can terminate, for example, in a pointed or flat state or can also be of any other desired shape. The depressions which are to be produced in the workpiece should have different dimensions. This is achieved in that some parts of the structure come into contact with the workpiece before other parts of the structure. The earlier contact is achieved, for example, in that some sub-structures of the workpiece project into the cavity to a greater extent than other sub-structures. It is preferably also the case that the parts of the structure are configured so as to achieve the different dimensions. Therefore, in one configuration, the teeth are of different sizes or have different geometries.

As an alternative, or in addition, the aforementioned tool is configured such that the structure has teeth which produce depressions of which the dimensions are larger than the finished dimensions of the depressions between the elevations which are to be produced. In a further configuration, the structure between the aforementioned teeth is such that the workpiece is not subjected to any forming operation. Therefore, the radial spacing between the teeth is preferably larger than the radial space between the depressions which are to be produced in the second step using a second tool. This makes it possible to produce an additional depression between the depressions which are achieved from the excessively large depressions.

In one configuration, the tool (preferably the first tool for realizing the first step of the method) is designed such that depressions of two different dimensions (one of larger and one of smaller dimensions) are achieved.

The apparatus serves preferably to implement the method according to one of the configurations above or below. The apparatus is therefore configured appropriately to allow it to carry out a configuration of the method. To this extent, the explanations associated with the method apply correspondingly to the apparatus.

One configuration of the apparatus involves a further tool—preferably a second tool for carrying out the second step of the method—which has a consistent structure. The structure is perfectly configured such that the desired elevations of the workpiece—preferably with the finished-dimensioned depressions/valleys located therebetween—are achieved, for example, during the second step of the method. Therefore, in one configuration, the tool has a plurality of teeth, which are essentially the same as one another and project into a cavity into which the workpiece which has been subjected to a forming operation using the first tool is introduced for further forming.

One configuration of the apparatus involves a force-exerting device, which subjects the workpiece to a force.

According to a further teaching, the invention relates to a product which has been produced from a workpiece using the method according to one of the preceding configurations and/or using the apparatus according to one of the aforementioned configurations. In one configuration, the product can have been subjected to further working operations.

One configuration of the product involves a product having been produced from a rotationally symmetrical workpiece.

One configuration of the product makes provision for the product to be in the form of a bevel gear. As an alternative, the product is in the form of a gearwheel or as an alternative, or in addition, bears spur-gear toothing. The appropriate shape here is produced by the method according to the invention and/or by the use of the apparatus according to the invention.

In specific terms, there are a large number of possible ways of configuring, and developing, the method according to the invention, the apparatus according to the invention and also the product according to the invention. For this purpose, reference is made, on the one hand, to the patent claims which are dependent on the independent patent claims and, on the other hand, to the following description of exemplary embodiments in conjunction with the drawings.

BRIEF DESCRIPTION

Figure 1:
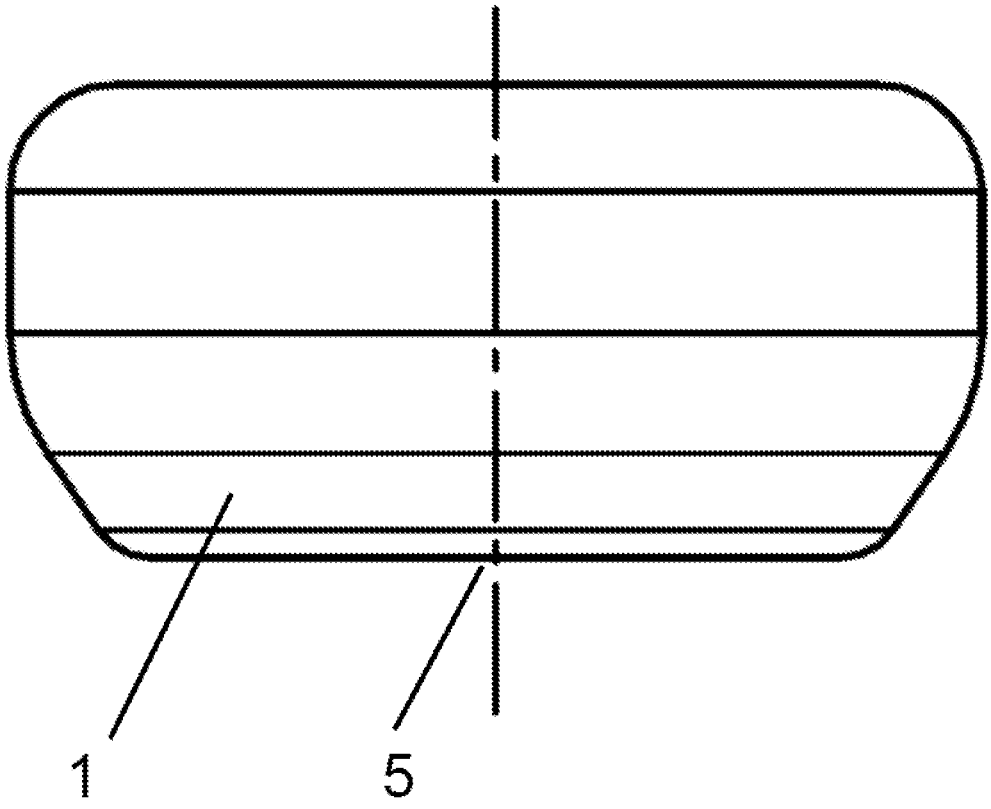
FIG. 1 shows a section through an example of a workpiece which is to be subjected to a forming operation in accordance with an embodiment of the present invention.

FIG. 1 shows a section through the workpiece 1 prior to the forming operation. The workpiece 1 is configured as being essentially rotationally symmetrical about the longitudinal axis 5.

Figure 2:
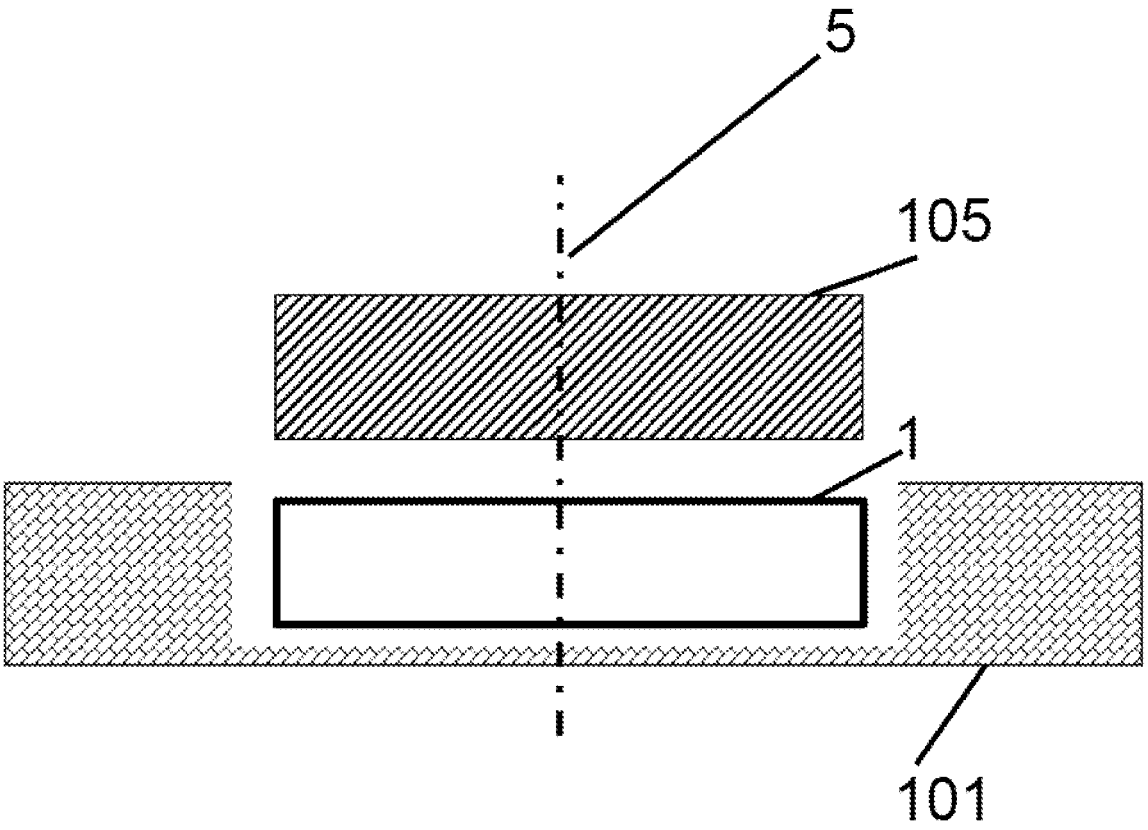
FIG. 2 shows a section through a schematic illustration of the forming operation for a workpiece during the first step of the method in accordance with an embodiment of the present invention.

FIG. 2 illustrates schematically how the workpiece 1 is located in the cavity which is enclosed by the first tool 101. A force-exerting device 105 is located above the workpiece 1 and, by moving along the longitudinal axis 5 of the workpiece 1, subjects the workpiece 1 to a mechanical force. As a result of this application of force, the material of the workpiece 1 flows in the direction of the inner wall of the first tool 101 and adapts itself to the structure provided in the inner wall. This is correspondingly the case in the second step of the method, using the second tool 102. In the configuration illustrated here, the longitudinal axis of the first tool 101 (and also, in the second step, of the second tool 102) and the longitudinal axis of the workpiece 1 which is to be subjected to a forming operation coincide along a longitudinal axis 5.

Figure 3:
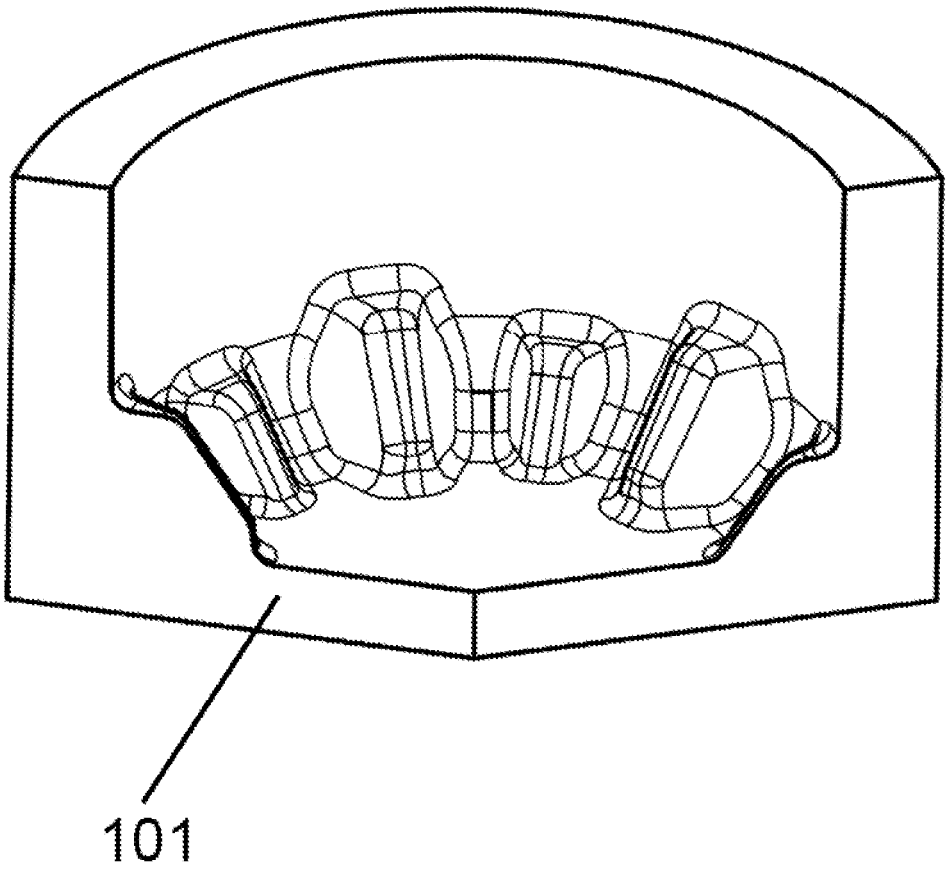
FIG. 3 shows a three-dimensional illustration of the cut-away tool for the first step of the method in accordance with an embodiment of the present invention.

FIG. 3 shows a part of a tool 101 which is used, by way of example, in the first step of the method.

An illustration is given of a plurality of teeth of the inner structure which project to different extents out of and/or into the interior space, which in this case is cut away. There are two differently sized types of teeth present in the example shown. The two types of teeth give rise to two differently sized depressions in the workpiece. In this arrangement, the different size of the teeth and the fact that they project into the enclosed interior space gives rise to the portions of the workpiece 1 coming into contact with the first tool 101 in some cases earlier and in some cases later, and therefore also being subjected to a more or less pronounced forming operation. The first workpiece 101 is configured, for example, such that first of all a flank, then the foot, and only finally the head, of a tooth comes into contact with the material of the workpiece 1. Accordingly, the different teeth are to be configured such that the respective flanks come into contact with the workpiece 1 earlier or later.

Figure 4:
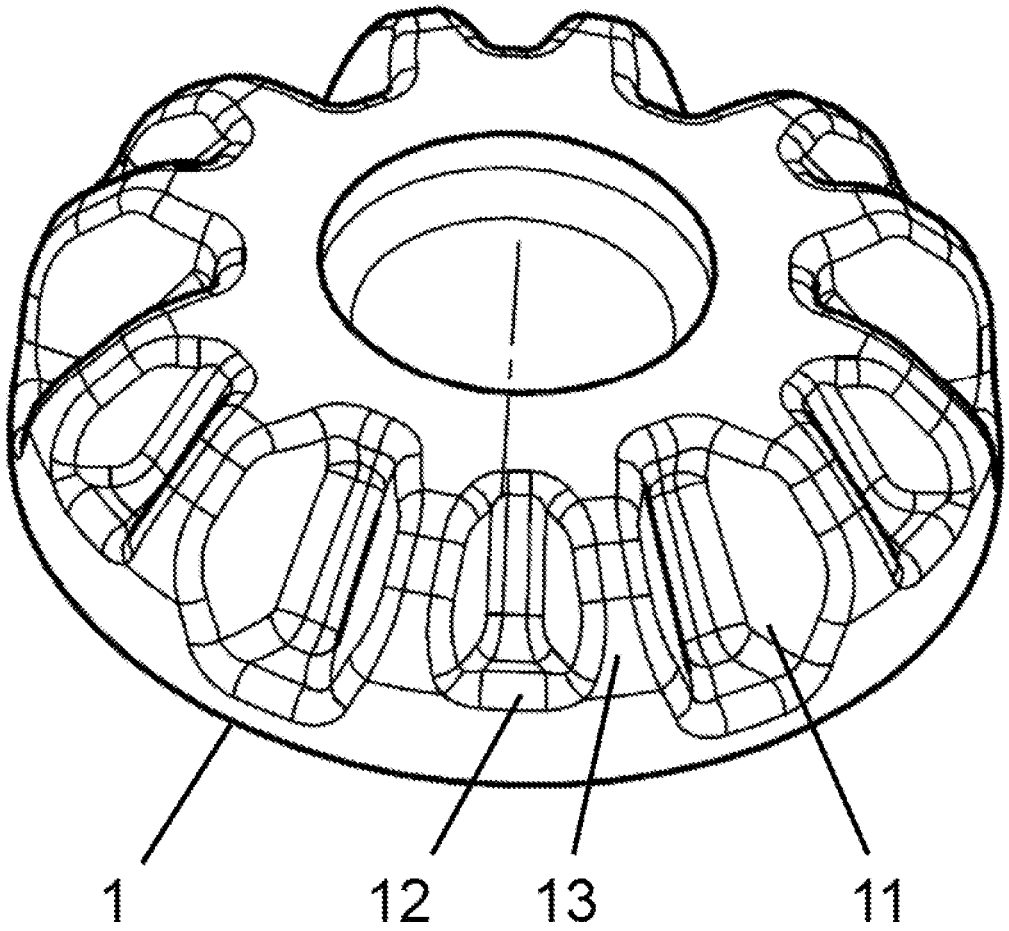
FIG. 4 shows a three-dimensional illustration of the workpiece formed by the first step in accordance with an embodiment of the present invention.

The forming operation in the first step using the first tool 101 gives rise to the blank with depressions which is illustrated in FIG. 4.

The workpiece 1 which has been subjected to a forming operation by way of the first step has deeper or larger depressions 11 and shallower or smaller depressions 12. In the configuration illustrated, the different depressions 11, 12 alternate with one another radially around it. The depressions 11, 12 are located mainly on the outer side surface of the workpiece 1 and are inclined inward to a more pronounced extent in the direction of the upper end side. In the second step, the material 13 in the regions between the depressions 11, 12 is subjected to the forming operations which produce the elevations (alternatively referred to, depending on the configuration, for example as teeth of a toothing formation) of the workpiece 1. In an alternative configuration, in the case of a workpiece which has been subjected to a forming operation—not illustrated here—the radial portions between the larger depressions 11 are free of depressions.

Figure 5:
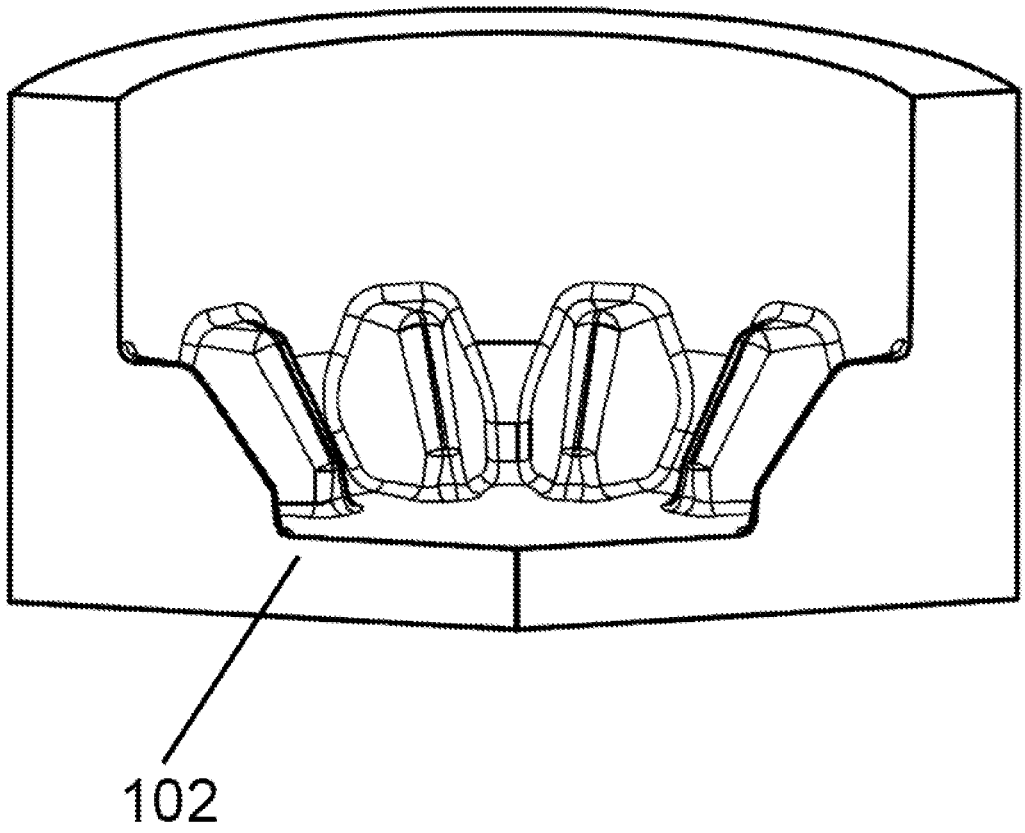
FIG. 5 shows a three-dimensional illustration of the cut-away tool for the second step of the method in accordance with an embodiment of the present invention.

In the second step of the method, the workpiece 1 of FIG. 4 is located in a similar construction to that in FIG. 2, although use is being made of the second tool 102, which is illustrated by way of example in FIG. 5.

The second tool 102 likewise has teeth, although these, in contrast to the first tool 101, are of just one type and are designed so as to correspond to the dimension of the valleys between the elevations of the finished product. The teeth therefore provide for the finished dimension.

Since the outer contour of the workpiece 1 has larger and smaller depressions 11, 12 following the first step, it is also the case that the respective material of the workpiece 1 comes into contact with the second tool 102 later or earlier. In particular, the arrangement of the depressions 11, 12 of the workpiece 1 (cf. FIG. 4) and the structure of the second tool 102 are such that the regions around the smaller depressions 12 are more in contact with the second tool 102 than the regions around the larger depressions 11. As a result, the material around the smaller depressions 12 flows in the direction of the larger depressions 11. Following the second step, the larger depressions 11 and the smaller depressions 12 form the valleys 20 between the elevations 21 of the workpiece 1. Since the valleys 20 have a predefined finished dimension, it is therefore the case that, in the second step, the larger depressions 11 are reduced in size to the finished dimension and, conversely, the smaller depressions 12 are increased in size to give the finished dimension.

Figure 6:
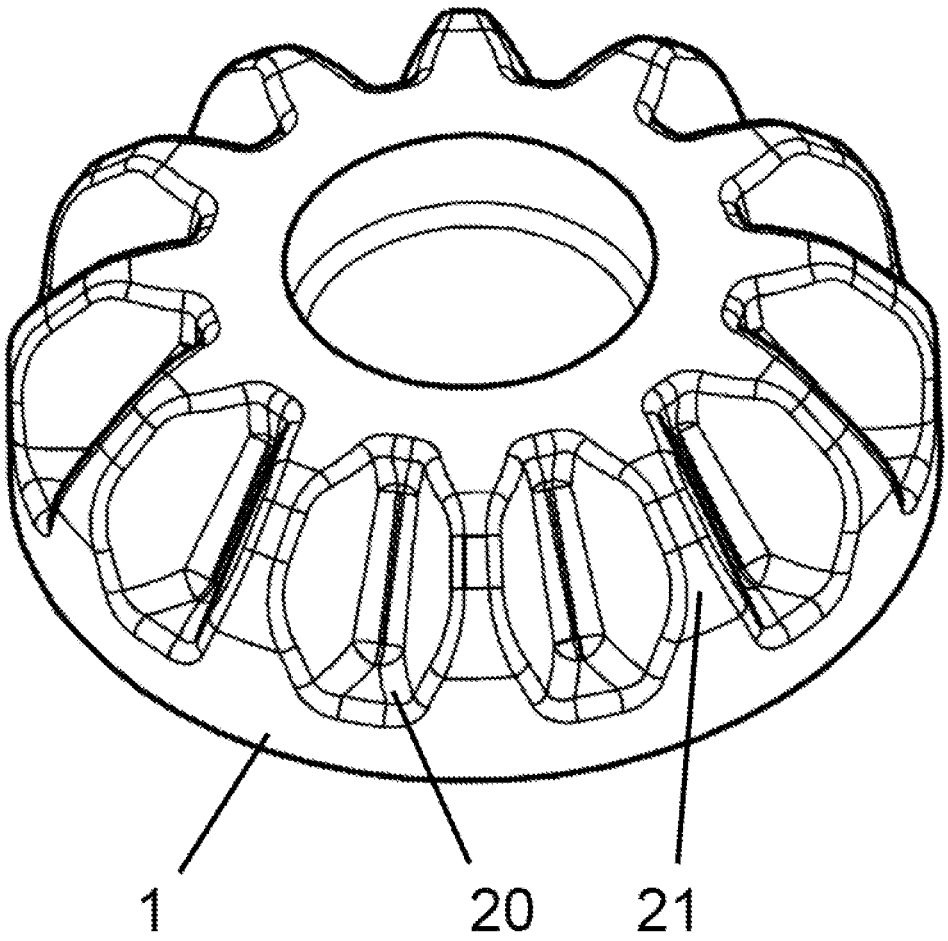
FIG. 6 shows a three-dimensional illustration of the definitively formed workpiece in accordance with an embodiment of the present invention.

The definitively formed workpiece 1 is illustrated in FIG. 6. It is possible to see here the elevations 21 and the depressions 20 located therebetween, both with finished dimensions.

The production method will be briefly summarized once again:

The starting point is a—preferably rotationally symmetrical or circular-cylindrical—workpiece 1, in which elevations 21 and depressions 20 located therebetween are to be produced with finished dimensions.

In a first step, larger depressions 11 and smaller depressions 12 are produced in the workpiece 1. In one configuration, the larger depressions 11 are larger than the final depressions 20.

In a second step, the elevations 21 are produced from the material of the regions 13 between the differently sized depressions 11, 12. The material around the smaller depressions 12 here flows in the direction of the larger depressions 11.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A method for forming elevations in a workpiece, comprising the steps of:

in a first step, producing a plurality of depressions in the workpiece using a tool, wherein the plurality of depressions include first depressions and second depressions, and wherein the first depressions have dimensions which differ from dimensions of the second depressions, and in a second step, producing elevations from regions of the workpiece between the first depressions and the second depressions.

2. The method according to claim 1, wherein in the first step, the second depressions are produced in the workpiece, the second depressions have different dimensions from the first depressions, and dimensions of the first depressions differ from dimensions of the second depressions based on a configuration of the tool.

3. The method according to claim 2, wherein in the first step, the first depressions have larger dimensions and are at smaller spacings from a longitudinal axis of the workpiece than the second depressions.

4. The method according to claim 3, wherein in the first step, the first depressions having larger dimensions are larger than dimensions of the first depressions after the second step.

5. The method according to claim 4, wherein in the first step, the first depressions and the second depressions alternate with one another regularly or irregularly.

6. The method according to claim 5, wherein in the first step, the plurality of depressions are produced such that material from regions of the workpiece in which the first depressions which will have larger dimensions come into contact with the tool earlier than material from regions in which the second depressions which will have smaller dimensions are to be produced.

7. The method according to claim 6, wherein in the second step, the elevations are produced such that material of the workpiece from the second depressions of smaller dimensions comes into contact with the tool earlier than material of the workpiece from the first depressions of larger dimensions.

8. The method according to claim 7, wherein in the second step, the elevations are produced such that material of the workpiece from the second depressions of smaller dimensions flows in the direction of the first depressions of larger dimensions.

9. The method according to claim 1, wherein in the first step, the first depressions are produced in the workpiece such that the first depressions have larger dimensions than depressions which are to be produced between the elevations.

10. The method according to claim 9, wherein in the first step, the first depressions are produced at a radial spacing from one another such that, in the second step for producing the elevations, there is space present within the radial spacing for at least one additional depression to be produced between the elevations.

11. The method according to claim 10, wherein in the first step, the space for the at least one additional depression remains in an unworked state.

12. An apparatus for forming elevations in a workpiece, comprising:

a first tool including a first cavity configured to accommodate the workpiece, and first teeth projecting into the first cavity and radially positioned about a longitudinal axis of the first tool; and a second tool including a second cavity configured to accommodate the workpiece, and second teeth projecting into the second cavity and radially positioned about a longitudinal axis of the second tool;

wherein:

end regions of the first teeth of the first tool are at different spacings from the longitudinal axis of the first tool, at least two of the first teeth of the first tool have different dimensions, and the second teeth of the second tool have the same dimensions.

13. A method for forming elevations in a workpiece, comprising the steps of:

in a first step, producing a plurality of depressions in the workpiece using a tool, wherein the plurality of depressions include first depressions and second depressions, and wherein the first depressions have dimensions which differ from dimensions of the second depressions, and in a second step, producing elevations from regions of the workpiece between the first depressions and the second depressions, wherein dimensions of the first depressions have larger dimensions and are at smaller spacings from a longitudinal axis of the workpiece than the second depressions based on a configuration of the tool.

14. The method according to claim 13, wherein in the first step, the second depressions are produced in the workpiece.

15. The method according to claim 13, wherein in the first step, the first depressions and the second depressions alternate with one another regularly or irregularly.

16. The method according to claim 13, wherein in the first step, the plurality of depressions are produced such that material from regions of the workpiece in which the first depressions are produced come into contact with the tool earlier than material from regions in which the second depressions are produced.

17. The method according to claim 13, wherein in the second step, the elevations are produced such that material of the workpiece from the second depressions comes into contact with the tool earlier than material of the workpiece from the first depressions.

18. The method according to claim 17, wherein in the second step, the elevations are produced such that material of the workpiece from the second depressions flows in the direction of the first depressions.

19. The method according to claim 13, wherein in the first step, the first depressions are produced in the workpiece such that the first depressions have larger dimensions than depressions which are to be produced between the elevations.

20. The method according to claim 19, wherein in the first step, the first depressions are produced at a radial spacing from one another such that, in the second step for producing the elevations, there is space present within the radial spacing for at least one additional depression to be produced between the elevations.

* * * * *